US010470591B1

(12) United States Patent
Heiden et al.

(10) Patent No.: US 10,470,591 B1
(45) Date of Patent: Nov. 12, 2019

(54) TWO-PIECE CORRUGATED SHELVING DISPLAY WITH TWO-PANEL SHELVES

(71) Applicant: Green Bay Packaging, Inc., Green Bay, WI (US)

(72) Inventors: Chad Heiden, Hartford, WI (US); Michael Bagatta, Grafton, WI (US); Kyle Kozlowski, Two Rivers, WI (US); Kyle Wyse, Wauseon, OH (US)

(73) Assignee: Green Bay Packacing, Inc., Green Bay, WI (US)

( * ) Notice: Subject to any disclaimer, the term of this patent is extended or adjusted under 35 U.S.C. 154(b) by 0 days.

(21) Appl. No.: 15/981,330

(22) Filed: May 16, 2018

Related U.S. Application Data

(60) Provisional application No. 62/508,432, filed on May 19, 2017.

(51) Int. Cl.
*A47F 5/11* (2006.01)
*B31D 5/04* (2017.01)

(52) U.S. Cl.
CPC ..... *A47F 5/116* (2013.01); *B31D 5/04* (2013.01)

(58) Field of Classification Search
CPC ..... A47F 5/116; A47F 5/0018; A47F 5/11; A47B 43/02; A47B 47/06; B31D 5/04
See application file for complete search history.

(56) References Cited

U.S. PATENT DOCUMENTS

| | | | | |
|---|---|---|---|---|
| 1,124,175 | A * | 1/1915 | Sackett | A47B 3/10 108/59 |
| 3,860,305 | A * | 1/1975 | Bergman | A47B 43/02 229/162.1 |
| 3,877,396 | A * | 4/1975 | Patterson | A47B 47/06 108/183 |
| 6,612,669 | B2 * | 9/2003 | Grueneberg | A47B 43/02 108/165 |
| 6,715,623 | B2 * | 4/2004 | Broerman | A47F 5/116 211/149 |
| 8,485,370 | B2 * | 7/2013 | Dewhurst | A47F 5/116 211/135 |
| 8,857,633 | B2 | 10/2014 | Dewhurst | |
| 9,474,389 | B2 | 10/2016 | Pfeifer et al. | |
| 9,743,783 | B1 * | 8/2017 | Bersamin | A47F 5/116 |
| 10,123,635 | B2 * | 11/2018 | Lilja | A47B 43/02 |
| 2004/0016375 | A1 * | 1/2004 | Grueneberg | A47B 43/02 108/115 |
| 2004/0148825 | A1 * | 8/2004 | Myers | A47F 5/116 40/124 |
| 2008/0169339 | A1 * | 7/2008 | Moser | B65D 5/5213 229/108.1 |

(Continued)

*Primary Examiner* — Ko H Chan
(74) *Attorney, Agent, or Firm* — Boyle Fredrickson, S.C.

(57) ABSTRACT

A collapsible shelving display that can be shipped and stored in a generally flat configuration and folded into an erected display configuration formed of a first and second blank of affixed material. The collapsible display includes a series of shelf surfaces formed of a front shelf portion extending from the first blank of material and a rear shelf portion extending from the second blank of material, where the shelf surfaces are supported by ribs that extend laterally across the display. Adjacent ribs may be separated by pivotable braces that provide the second blank with increased rigidity during assembly to facility machine handling.

20 Claims, 12 Drawing Sheets

(56) References Cited

U.S. PATENT DOCUMENTS

| | | | | |
|---|---|---|---|---|
| 2010/0181443 | A1* | 7/2010 | Bojie | A47F 5/11<br>248/146 |
| 2014/0014606 | A1* | 1/2014 | Mestres Armengol | A47F 5/116<br>211/135 |
| 2015/0068998 | A1* | 3/2015 | Smith | A47F 5/116<br>211/135 |
| 2017/0231404 | A1* | 8/2017 | Pratsch, Jr. | A47B 43/02<br>211/135 |
| 2017/0245661 | A1* | 8/2017 | Heuer | A47B 43/00 |
| 2018/0160825 | A1* | 6/2018 | Abel | A47F 5/116 |
| 2018/0289178 | A1* | 10/2018 | McMillan-Sweat | A47F 5/116 |
| 2019/0069694 | A1* | 3/2019 | Smith | A47F 5/116 |

* cited by examiner

TWO-PIECE CORRUGATED SHELVING DISPLAY WITH TWO-PANEL SHELVES

CROSS-REFERENCE TO RELATED APPLICATION

This application claims the benefit of U.S. Ser. No. 62/508,432 filed May 19, 2017, the disclosure of which is incorporated herein in its entirety.

BACKGROUND OF THE INVENTION

1. Field of the Invention

The present invention relates to a shelving display, and more particularly a collapsible shelving display formed from two pieces of corrugated board that is well suited for mechanical assembly.

2. Background

Temporary product displays and mobile product displays are becoming increasing common place in retailer environments. Such displays are often installed to promote the sale of temporary or seasonal products. However, such displays, which may include integrated product shelving, often include multiple pieces that have to be joined together, rendering them more difficult to ship and assemble. Accordingly, there is need for a shelving display that may be easily assembled in retail locations without significant installation training.

Additionally, due to the temporary nature of such displays, they are often formed of inexpensive materials such as corrugated board. However, the assembly of a display that includes multiple independent pieces of corrugated board being folded into a single display unit can be difficult to assemble and prone to misfolding, tearing, and bending, all of which may reduce the structural integrity of the assembled display. Accordingly, there is need for a shelving display formed of a disposable or recyclable corrugated board with reinforced shelves that can support the weight of retail products, and that can be easily assembled on site.

There is also need for a shelving display that is collapsible for both ease of transportation, e.g., shipping, and storage when not in use. There is also need for a shelving display that can be formed of relatively low cost materials, such as corrugated board, which may also be recycled when use of the display is complete.

Furthermore, there is also a need for a shelving display that is formed of blanks that provides sufficient structural rigidity for mechanical handling during assembly, for example by means of a polyjoiner machine that mechanically affixes blanks together during the assembly of the shelving display.

BRIEF DESCRIPTION OF THE INVENTION

By way of nonlimiting summary, in accordance with one aspect, the present invention addresses the above-referenced needs by providing a collapsible display that includes a series of easily assembled shelves. The display of the present invention is formed of first and second blanks of corrugated board, which are affixed to one another and configured to transition between a flat configuration and an erected configuration. The first and second blanks of material are configured to provide sufficient rigidity that they may facilitate machine handling during assembly of the collapsible display, for example by the use of a polyjoiner machine. The present invention provides a display that is particularly well-suited for transportation and storage in a flat configuration, and use in an erected configuration via folding portions of the first and second blanks without adhesive, fasteners or the like to maintain the display in the erected configuration. The present invention also provides a display that is particularly well-suited for repeatedly transitioning between the flat configuration and the erected configuration, but that may also be recycled when use of the display is complete.

In one embodiment of the present invention, the display may include a first blank of material that defines a series of outer panels of the display and a plurality of front shelf portions, that is affixed to a second blank of material that defines a plurality of rear shelf portions, a plurality of ribs and a series of pivotable braces. The first and second blanks of material may be configured to be folded into an erected configuration in which the front shelf portions respectively engage corresponding rear shelf portions to define a plurality of shelf surfaces. The resultant shelf surfaces may have a surface area substantially equal to a cross-sectional area of the display in the erected configuration and each of the ribs engages an underside of a shelf surface along a width of the display.

In another embodiment, each brace in the series of pivotable braces is pivoted into a folded position that is substantially parallel with the side panels of the display in the erected configuration.

In another embodiment, the pivoting of the braces results in the formation of a series of voids between adjacent ribs. The voids may be sized to allow a corresponding rear shelf portion to pass therethrough without obstruction.

In another embodiment, each of the front shelf portions may include a tab and each of the rear shelf portions may include a corresponding slot, which is configured to receive the tab when the front shelf portions respectively engage corresponding rear shelf portions.

In another embodiment, when the tab extends through the tab receiving slot it may further engage a corresponding rib in a frictional engagement that inhibits disengagement of the front shelf portion and rear shelf portion.

The present invention also provides a method of folding a collapsible display, including the steps of: providing first and second blank of material, where the first blank comprises a plurality of elongated outer panels that are separated by the pivot lines and the second blank comprises a plurality of elongated inner panels that are separated by the pivot lines, and wherein the second blank is affixed within the first blank; transitioning the first and second blank of material from a generally flat configuration to a generally erected configuration by pivoting the first and second blanks of material about their respective pivot lines; folding a plurality of pivotable braces located within an elongated panel of the second blank into a folded configuration to reveal a series of voids disposed between adjacent ribs that extend transversely between opposing sides of the display; folding a series of rear shelf portions that extend from the second blank through the corresponding void to a folded position that engages an upper edge of a corresponding rib with an underside of the rear shelf portion; and folding a corresponding series of front shelf portions that extend from the first blank, wherein each set of front and rear shelf portions forms a f shelf surface having a surface area substantially equal to a cross sectional area of the display in the erected configuration.

These and other features and aspects of the present invention will be better appreciated and understood when considered in conjunction with the following description and the accompanying drawings. It should be understood, however, that the following description, while indicating representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
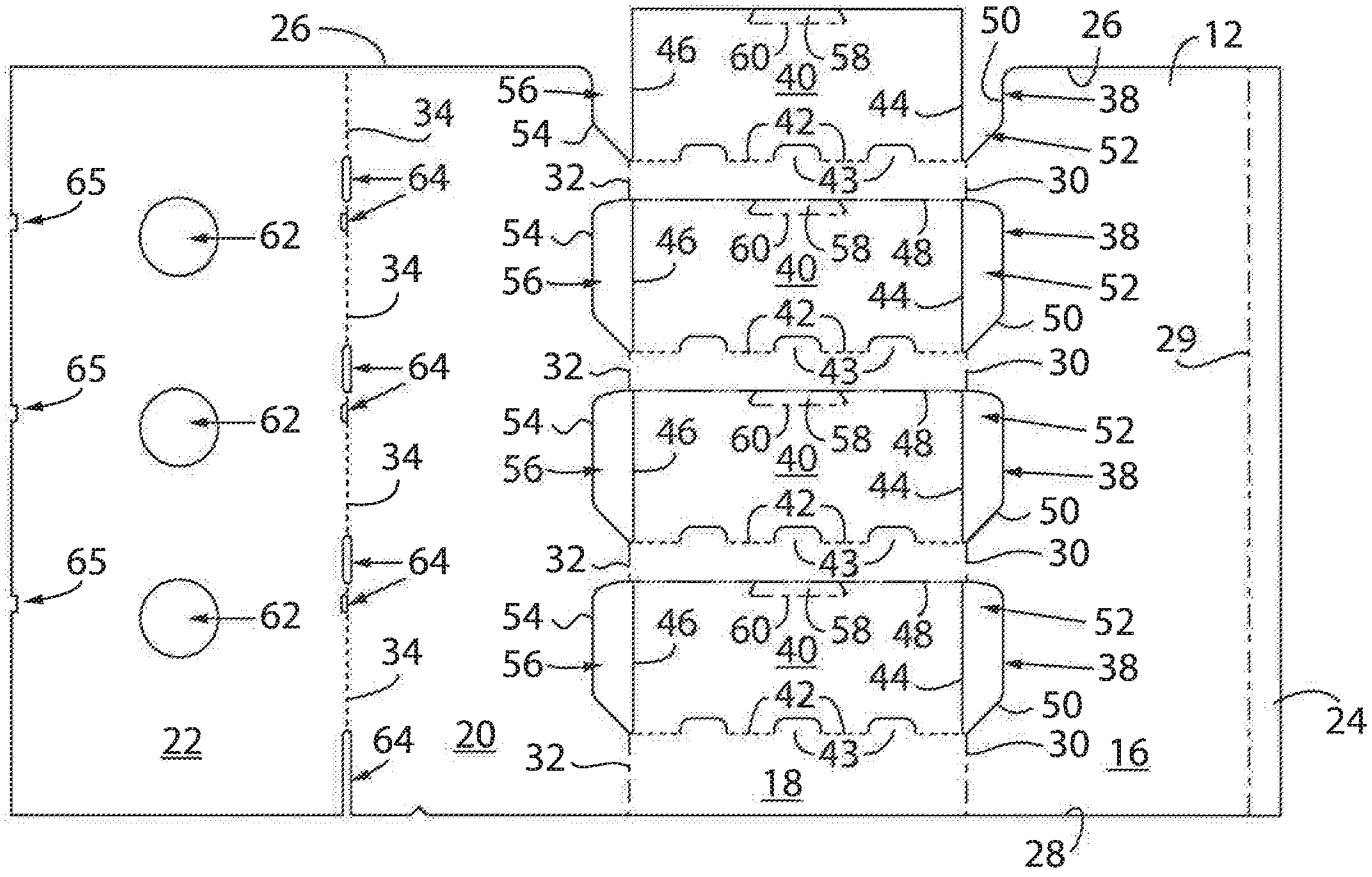
FIG. 1 is a plan view of a first blank of material for use in forming a shelving display in accordance with one embodiment of the present invention.

In describing the embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected," "attached," or terms similar thereto are often used. They are not limited to direct connection, but include connection through other elements where such connection is recognized as being equivalent by those skilled in the art.

DETAILED DESCRIPTION

The various features and advantageous details of the subject matter disclosed herein are explained more fully with reference to the non-limiting embodiment described in detail in the following description.

Figure 2:
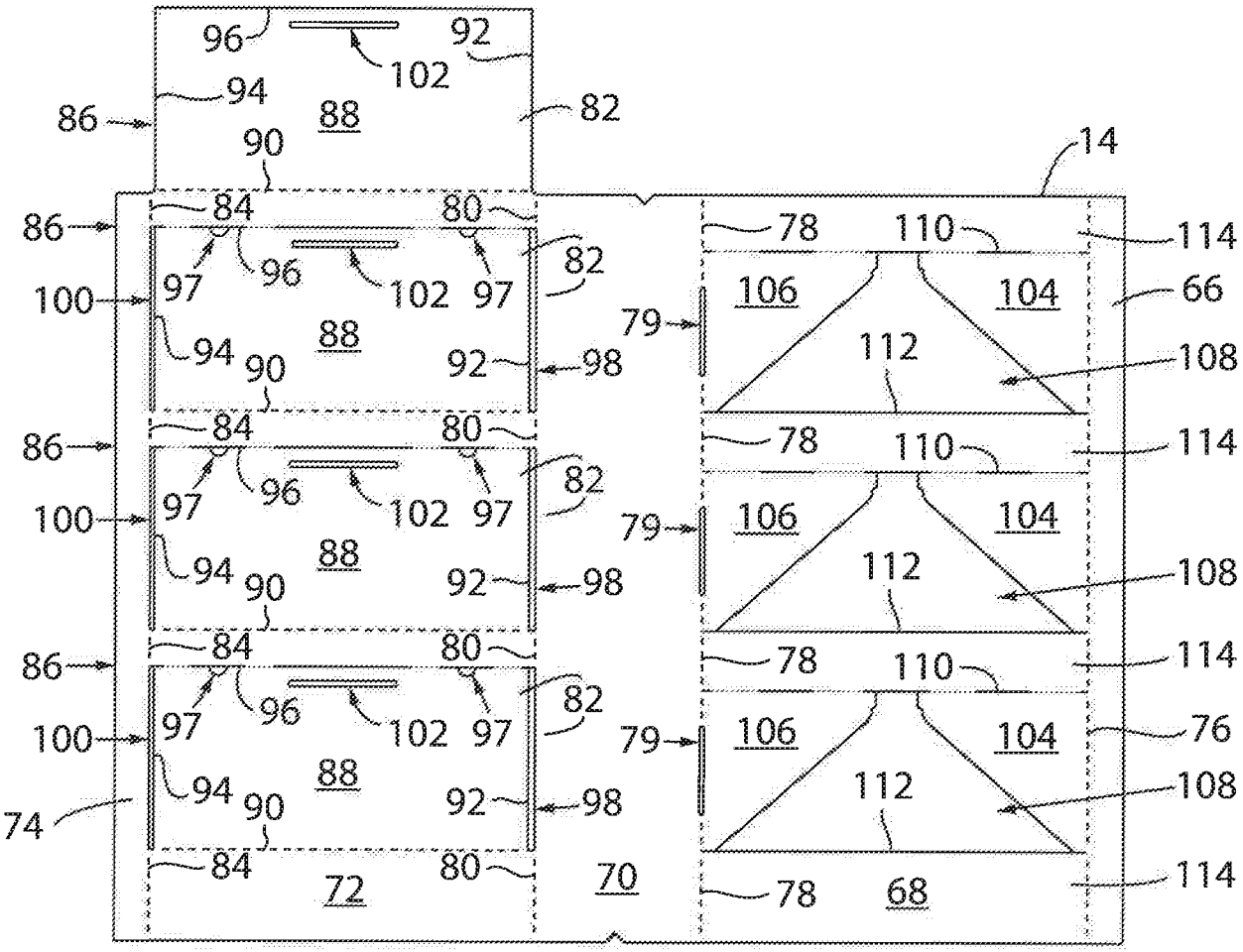
FIG. 2 is a plan view of a second blank of material for use in forming a shelving display in accordance with one embodiment of the present invention.
Figure 3:
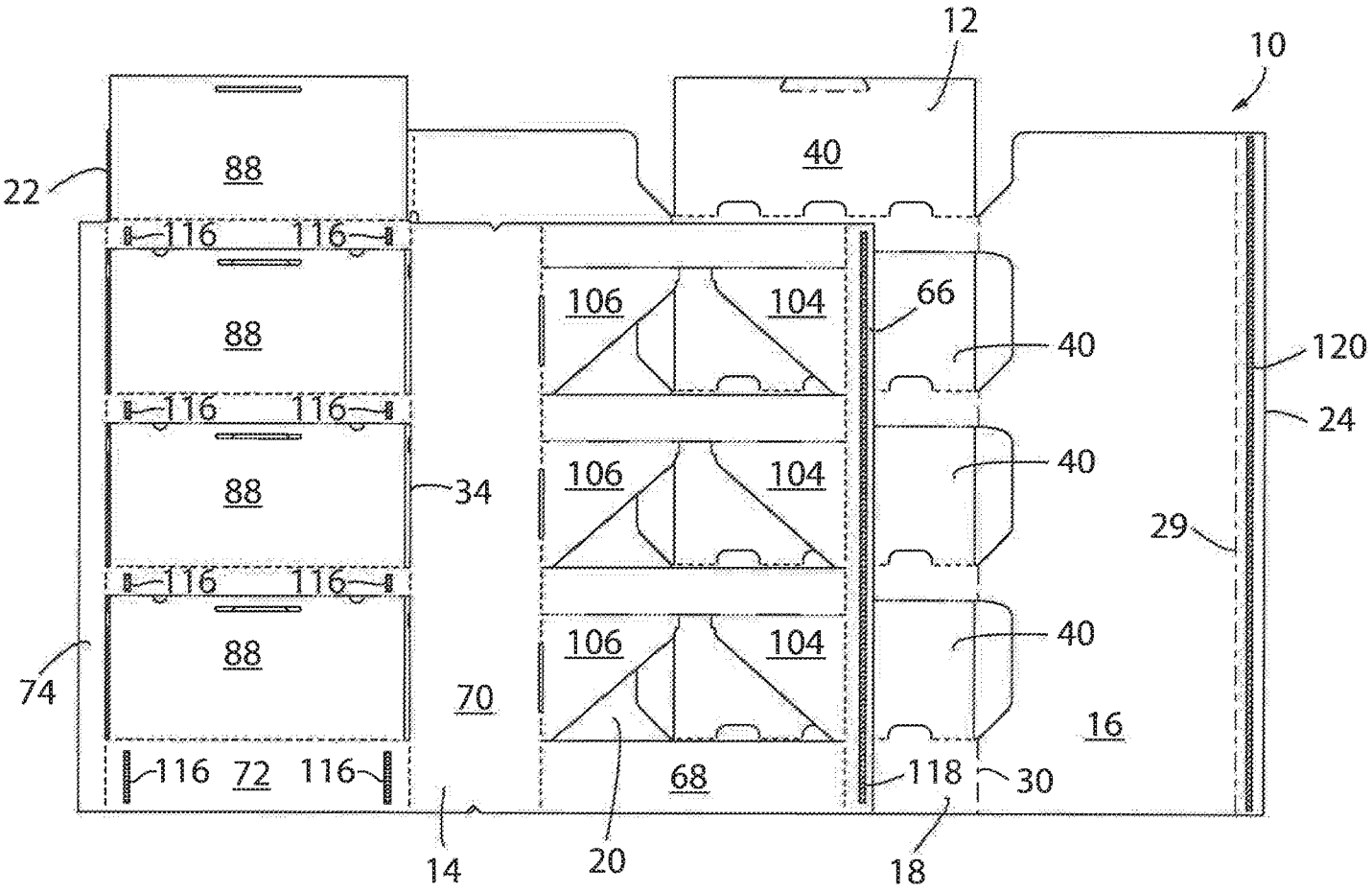
FIG. 3 is a plan view of the second blank of material of FIG. 2 overlying the first blank of material of FIG. 1 in accordance with one embodiment of the present invention.
Figure 4:
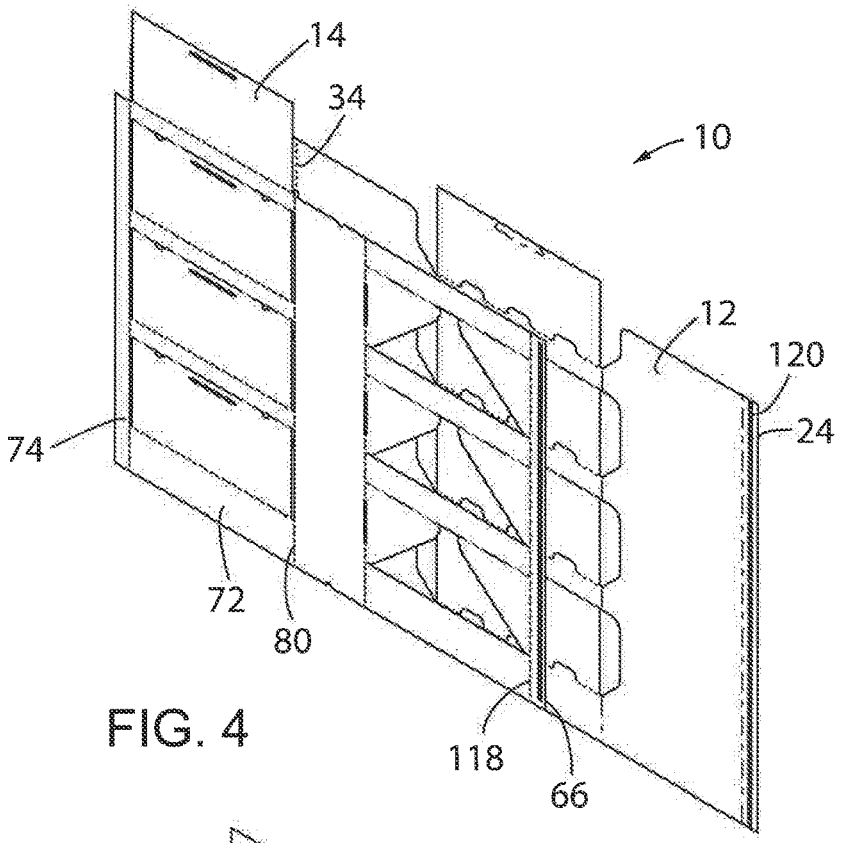
FIG. 4 is a perspective view of the second blank of material of FIG. 2 partially engaging and affixed to the first blank of material of FIG. 1 in accordance with a step-wise assembly of one embodiment of the present invention.

Referring initially to FIGS. 1-3 and particularly FIG. 1, there is shown a display 10 according to one embodiment of the present invention. The display 10 generally is made of a first blank 12 and a second blank 14 of sheet material. The sheet material may consist of corrugated board or any similar material suitable for use in container and display construction. In a manner as is known, the corrugated board consists of a fluted corrugated core located between two sheets of kraft paper or linerboard, in a manner as is known. In one embodiment, the flutes of the inner core have a longitudinal axis that is parallel to the longitudinal axis of the folded and erected display 10. The blanks 12 and 14 may be stamped or cut from one or more sheets of the sheet material while in a substantially flat orientation, affixed to one another in the manner described below, and subsequently folded to form the display 10. The outer surface of the display 10 may be printed to display information such as content details, product information, folding instructions, orientation indicia and the like. The outer surface of the display 10 may also contain graphics, advertising information or ornamental elements.

FIG. 1 illustrates an interior view of the first blank 12, which when folded will form the outer surface of the display 10, as described further below. The first blank 12 is formed of a single piece of sheet material, in a flat orientation. The blank 12 includes primarily a first side panel 16, a front panel 18, a second side panel 20 and a rear panel 22. The first side panel 16 also includes a fixation panel 24, extending from a side of the first side panel 16 along the length of the first blank 12, between the top edge 26 and bottom edge 28.

Still referring to FIG. 1, the first side panel 16 is hingedly attached to the fixation panel 24 about a score or crease line 29. The opposing side of the first side panel 16 is hingedly attached to the front panel 18 about a score or crease line 30. The crease line 30 may be an interrupted crease line 30, as shown in FIG. 1. The opposing side of the front panel 18 is hingedly attached to the second side panel 20 about a score or crease line 32. Similarly, crease line 32 may also be an interrupted crease line 32. The opposing side of the second side panel 18 is hingedly attached to the rear panel 22 about line a 34, which may also be an interrupted line. As shown in FIG. 1, line 34 may be a perforated line 34. However, other lines, such as score or crease lines are considered well within the scope of the present invention. As illustrated in FIG. 1, the lines 29, 30, 32, and 34 are parallel in orientation, allowing the panels 16, 18, 20, 22, and 24 to be folded into a cuboid display 10 as is described in further detail below.

Still referring to FIG. 1, the front panel 18 and rear panel 22 will be described in further detail below. As illustrated in FIG. 1, the front panel 18 includes a series of front shelf portions 38 disposed therein. In the illustrative embodiment of FIG. 1, four front shelf portions 38 are shown in the first blank 12. However, any number of front shelf portions 38 are considered within the scope of the present invention. Each of the front shelf portions 38 includes a front shelf panel 40 that is hingedly attached to the front panel 18 about a line 42, which may be interrupted or broken by upwardly extending tabs 43. As shown in FIG. 1, line 42 may be a perforated line 42. However, other lines, such as score or crease lines are considered well within the scope of the present invention.

Still referring to FIG. 1, the first lateral edge 44 and opposing second lateral edge 46 of each front shelf panel 40 are cut from the surrounding material of the first blank 12. Furthermore, the upper edge of each front shelf panel 40 is releasably affixed to the front panel 18 at a perforated score line 48 extending from the first lateral edge 44 to the second lateral edge 46, which during assembly of the display 10 is configured to be separated as will be described below. Accordingly, in this configuration, once the perforated score line 48 is entirely ruptured the front shelf panel 40 is allowed to independently pivot about line 42, which is shown in FIG. 1 as being located along the lower edge of the front shelf panel 40.

Additionally, for each front shelf portion 38, a cut line 50 is located adjacent and offset from the first lateral edge 44, within the surface area of the first side panel 16 of the first blank 12. Resultantly, a void 52 is formed in the first side panel 16 of the first blank 12, adjacent to the first lateral edge 44 of the front shelf portions 38, between the first lateral edge 44 and the cut line 50. On the opposite side of the front shelf portions 38, a cut line 54 is similarly located adjacent and offset from the second lateral edge 46, within the surface area of the second side panel 20 of the first blank 12. Resultantly, a void 56 is formed in the second side panel 20 of the first blank 12, and adjacent to the second lateral edge 46 of the front shelf portions 38.

Additionally, still referring to each front shelf portion 38, a tab 58 is disposed within the surface area of the front shelf panel 40 of each front shelf portion 38, as illustrated in FIG. 1. The tab 58 is defined by a score or crease line 60, extending along the bottom edge of the tab 62, and perforated score line 48 previously described. As such, the tab 58 is hingedly attached to the front shelf panel 40 about the crease line 60, and may pivot about the crease line 60 accordingly. Pivoting of the tab 58 may be facilitated by a user placing one or more fingers into the tab 58 and pulling or pushing on the tab 58. The tab 58 facilitates engagement and securing the front shelf panel 40 to its counterpart rear shelf panel 88, formed in the second blank 14, as will be described in detail below.

As it relates to the rear panel 22 of the first blank 12, and still referring to FIG. 1, the rear panel 22 may include a series of central voids 62. As illustrated in FIG. 1, the voids 62 may be of a size sufficient to allow a user to place a hand through the rear panel 22, to facilitate in assembly of the display 10 in its erected configuration. The voids 62 may be located at heights approximately equal to that of the front shelf portions 38, as to allow direct access to the shelves of the display 10. As shown in FIG. 1, a void 62 need not be placed adjacent the uppermost front shelf portions 38, which can be accessed from above the top edge 26 of the first blank 12.

Additionally, still referring the rear panel 22 of the first blank 12, as shown in FIG. 1, a series of apertures 64 located along the crease line 34 between the rear panel 22 and the second side panel 20 may interrupt the crease line 34 so as to provide relief areas for components of the second blank 14 when the display is assembled in a folded configuration, as will be described in further detail below.

Referring now to FIG. 2, the interior view of the second blank 14 of the display 10 is illustrated, formed of a single piece of packaging material, in a flat orientation. The blank 14 includes primarily a first side panel 66, a front panel 68, a second side panel 70, a rear panel 72, and a fixation panel 74. The first side panel 66 is hingedly attached to the front panel 68 about a line 76. The line 76 may be a perforated line 76, as shown in FIG. 2. The opposing side of the front panel 68 is hingedly attached to the second side panel 70 about a line 78, which may be interrupted by voids 79 as shown in FIG. 2. Similarly, line 78 may be a perforated line, as shown in FIG. 2. The opposing side of the second side panel 70 is hingedly attached to the rear panel 72 about a line 80. As shown in FIG. 2, line 80 may be an interrupted or perforated line, interrupted by various crushable areas 82. The opposing side of the rear panel 72 is hingedly attached to the fixation panel 74 about a line 84, which may be a perforated line. As illustrated in FIG. 2, the lines 76, 78, 80, and 84 are parallel in orientation, allowing the panels 66, 68, 70, 72, and 74 to be folded in an incomplete cuboid fashion when display 10 is erected as will be described in detail below.

Still referring to FIG. 2, the rear panel 72 will now be described in further detail. As illustrated in FIG. 2, the rear panel 72 includes a series of rear shelf portions 86 disposed therein. In the illustrative embodiment of FIG. 2, four rear shelf portions 86 are shown in the second blank 14. However, any number of rear shelf portions 86, corresponding to the number of the front shelf portions, are considered within the scope of the present invention. Each of the rear shelf portions 86 includes a rear shelf panel 88 that is hingedly attached to the rear panel 72 about a line 90. Line 90 may be a perforated line, however, other lines, such as crease or score lines are considered well within the scope of the present invention. The first lateral edge 92 and opposing second lateral edge 94 of each rear shelf portion 86 are cut from the surrounding material of the second blank 14. Furthermore, the upper edge of each rear shelf portion 86 is releasably affixed to the rear panel 72 at a perforated score line 96 extending from the first lateral edge 92 to the second lateral edge 94, which during assembly of the display 10 is configured to be separated as will be described below. Accordingly, in this configuration, once the perforated score line 96 is entirely ruptured the rear shelf portions 86 are allowed to independently pivot about line 90. One or more voids 97, which are sized to allow a user's finger to pass through the voids 97 may extend into the rear shelf panel 88 below the perforated score line 96. In use, the voids 97 may be used to facilitate pulling the rear shelf panel 88 down, about the pivot line 90 when disengaging from the rear panel 72.

Additionally, a void 98 is formed in the rear panel 72 of the second blank 14, adjacent to the first lateral edge 92 of the rear shelf portions 86. On the opposite side of the rear shelf portions 86, a void 100 is similarly formed in the real panel 72 of the second blank 14, adjacent to the second lateral edge 94 of the rear shelf portions 86.

A tab receiving slot 102 is disposed within the surface area of the rear shelf panel 88 of each rear shelf portion 86, as illustrated in FIG. 2. The tab receiving slot 102 may be a narrow slot or void, which is configured to receive the tab 58 from the corresponding front shelf panel 40 therein when the display 10 is erected. The tab 58 may be retained within the tab receiving slot 102 by way of frictional engagement without the use of adhesive, tape, fasteners, or the like.

Turning now to the front panel 68 of the second blank 14, and still referring to FIG. 2, the front panel 68 may include a series of first pivotable handling braces 104 extending inwardly from the fold line 76 towards the center of the front panel 68, and a series of second pivotable handling braces 106 extending inwardly from the fold line 78 towards the center of the front panel 68. As illustrated in FIG. 2, a series of voids 108 may define the lateral space between the respective first pivotable handling braces 104 and the second pivotable handling braces 106. As will be described in further detail below, the pivotable handling braces 104, 106 provide increased structural rigidity and surface area to the second blank 14 during handling and assembly when the second blank is in a substantially flat or unfolded configuration, and may then be folded inwardly into the display 10, when the display is oriented in the folded and erected configuration. In the flat configuration, shown in FIG. 2, the top edges of the pivotable handling braces 104, 106 may be releasably affixed to the front panel 68 by a perforated line 110 that extends from the crease line 76 to the crease line 78. Furthermore, as shown in FIG. 2, each void 108 is cut out of the front panel 68 having a lower edge 112 that is located approximately even and substantially parallel with fold line 90 of each corresponding rear shelf panel 88. Accordingly, when the display 10 is in a folded configuration, the lower edge 112 of void 108 will extend across the width of the display 10 and provide a supporting surface upon which the rear shelf panel 88 engages and rests. That is to say that the areas of the front panel 68, which remain between the intermittent voids 108, form braces or ribs 114, upon which the rear shelf panel 88 engages and rests. Furthermore, each tab 58 that extends through a corresponding tab receiving slot 102 may also engage the corresponding ribs 114 formed of the front panel 68 of the second blank 14. As will be shown in the subsequent figures, the ribs 114 are asymmetrically positioned below the surface area of the shelf surfaces 122 along the depth of the shelf surfaces 122, when the display 10 is folded into its erected configuration.

Turning now to FIG. 3, the second blank 14 is shown overlying the first blank 12 in an unfolded and unerected configuration, where the underlying portions of the first blank 12 cannot be seen through the surfaces of the overlying second blank 14.

In the overlapping configuration of the first blank 12 and second blank 14 shown in FIG. 3, various adhesive areas are shown. A series of first adhesive areas, are located between the rear panel 22 of the first blank 12 and the rear panel 72 of the second blank 14. While the overlying second blank 14 in FIG. 3 obscures the first adhesive areas from view, they are generally located at a position that correspond to the areas 116 shown in FIG. 3, but positioned between the two sandwiched blanks 12, 14. In one representative embodiment of the present invention, the first adhesive areas may be formed of a hot glue adhesive application; however, other fixation means known in the art are considered well within the scope of the invention. A second adhesive area 118 is shown applied to the outer or upwardly facing surface of the first side panel 66 of the second blank 14. As shown in FIG. 3, the second adhesive area 118 is a single elongated adhesive area; however other configurations are considered within the scope of the present invention. While not shown in the substantially flattened configuration of FIG. 3, the second adhesive area 118 is configured to subsequently affix the outer or upwardly facing surface of the first side panel 66 of the second blank 14 to the inner facing surface of the first side panel 16 of the first blank 12, when the first blank 12 is folded about crease line 30 during assembly, as will be described in further detail below. In one representative embodiment of the present invention, the second adhesive area 118 may be formed of a hot glue adhesive application; however, other fixation means known in the art are considered well within the scope of the invention. A third adhesive area 120 is shown applied to the outer or upwardly facing surface of the fixation panel 24 of the first blank 12. As shown in FIG. 3, the third adhesive area 120 is a single elongated adhesive area; however other configurations are considered within the scope of the present invention. While not shown in FIG. 3, the third adhesive area 120 will affix the outer or upwardly facing surface of the fixation panel 24 of the first blank 12 to the outer facing surface of the rear panel 22 of the first blank 12, when the first blank 12 is folded about crease lines 29, 30, 32 and 34 during assembly, as will be described in further detail below. In one representative embodiment of the present invention, the third adhesive area 120 may be formed of a cold glue adhesive application; however, other fixation means known in the art are considered well within the scope of the invention. While not shown in FIG. 3, a fourth adhesive area 121 is applied to the outer or downwardly facing surface of the fixation panel 74 of the second blank 14. The fourth adhesive area 121 is a single elongated adhesive area; however other configurations are considered within the scope of the present invention. While not shown in FIG. 3, the fourth adhesive area 121 will affix the outer or downwardly facing surface of the fixation panel 74 of the second blank 11 to the inner facing surface of the first side panel 16 of the first blank 12, when the first blank 12 is folded about crease lines 29, 30, 32 and 34 during assembly, as will be described in further detail below. In one representative embodiment of the present invention, the fourth adhesive area 121 may be formed of a cold glue adhesive application; however, other fixation means known in the art are considered well within the scope of the invention. When the various adhesive areas 116, 118, 120, and 121 have been affixed to their respective portions of the first and second blanks 12, 14, the display 10 will form a generally flattened configuration that is well suited for ease of shipping and storage. The display 10 may then be erected into a standing configuration upon demand as will be described below.

Turning now to FIGS. 4 through 7, the display 10 is shown in various steps during the process of folding the display 10 into its affixed and generally flattened configuration that is well suited for ease of shipping and storage. Beginning with FIG. 4, the second blank 14 is shown partially overlying the first blank 12, in the configuration shown in FIG. 3 and described above, where the blanks 12, 14 have yet to be adhesively affixed to one another.

Figure 5:
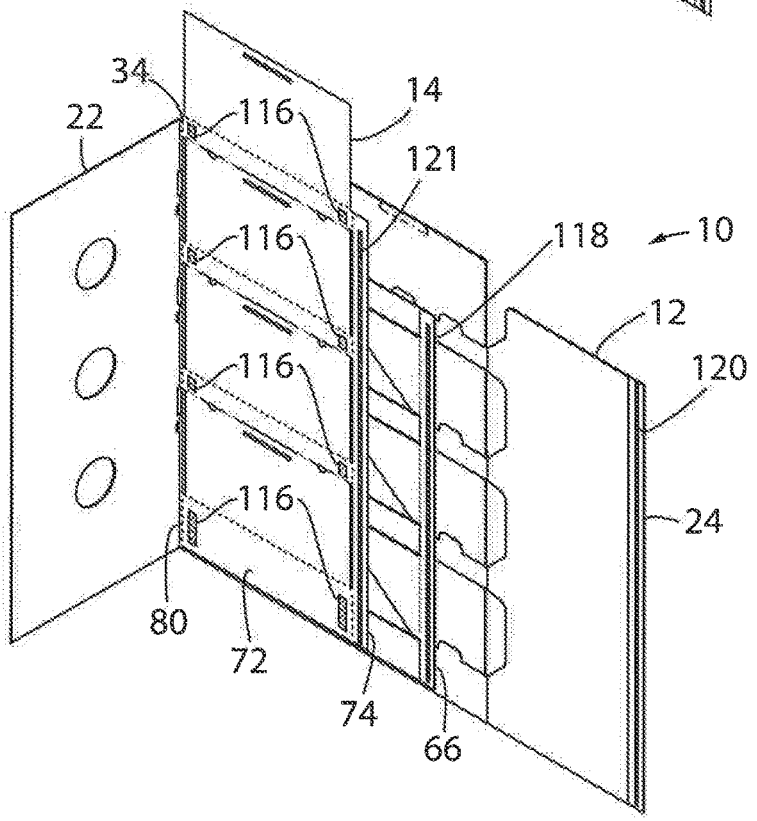
FIG. 5 is a perspective view of a first end portion of the second blank of material and a first end portion of the first blank of material folded partially inward in accordance with a step-wise assembly of one embodiment of the present invention.

In FIG. 5, the rear panel 72 has been rotated or folded approximately 180 degrees about line 80, such the outer surface of rear panel 72 and fixation panel 74 are upwardly facing. The first adhesive areas 116 have been applied to the outer surface of rear panel 72 while the fourth adhesive area 121 has been applied to the outer surface of fixation panel 74, both of which are now visible in an upwardly facing configuration. Additionally, still referring to FIG. 5, the rear panel 22 of the first blank 12 has been partially rotated or folded approximately 90 degrees about line 34. In this configuration, adhesive areas 116, 118, 120, and 121 are all exposed in an upwardly facing configuration.

Figure 6:
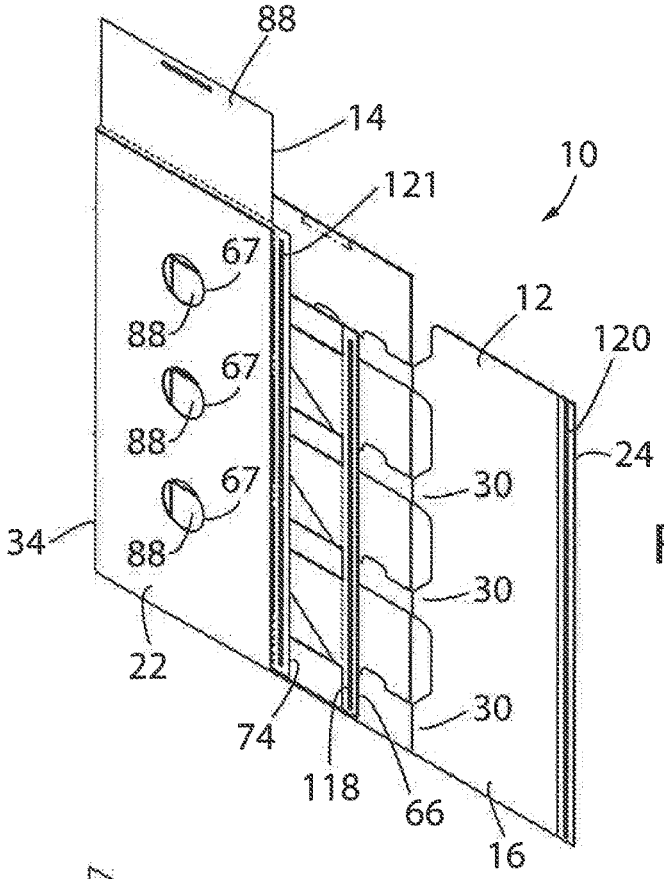
FIG. 6 is a perspective view of the first end portion of the second blank of material and the first end portion of the first blank of material being fully folded inward in accordance with a step-wise assembly of one embodiment of the present invention.

In FIG. 6, the rear panel 22 of the first blank 12 has been rotated or folded approximately an additional 90 degrees about line 34 from the position shown in FIG. 5, such that the inner surface of the rear panel 22 of the first blank engages and becomes adhesively affixed to the plurality of first adhesive areas 116 of the second blank 14. In this configuration, the inner surface of the rear panel 22 of the first blank 12 contacts and is adhesively affixed to the outer surface of the rear panel 72 of the second blank 14, with fold lines 80 and 34 generally overlying one another. As shown in FIG. 6, the rear panel 22 does not extend onto the fixation panel 74, such that the fourth adhesive area 121 remains exposed. Furthermore, in this partially folded configuration the rear shelf panels 88 of the series of rear shelf portions 86 may be seen through the voids 62 in the rear panel 22 of the first blank 12.

Figure 7:
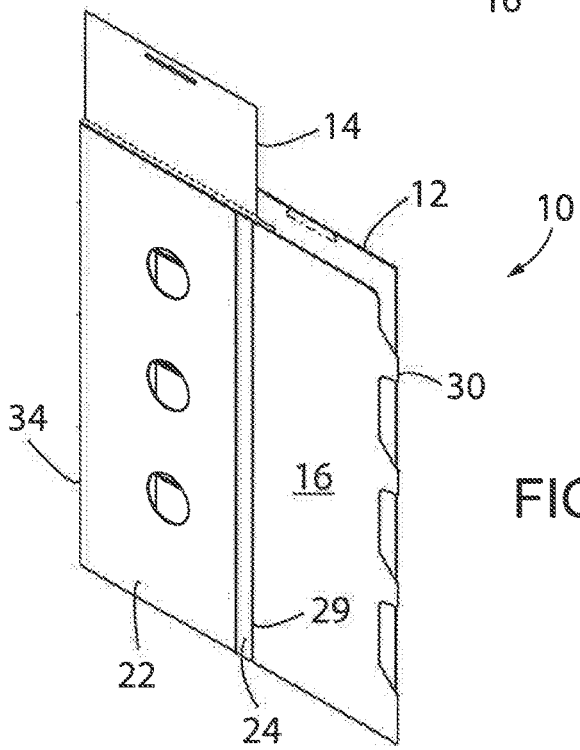
FIG. 7 is a perspective view of a second end portion of the first blank of material being fully folded inward to engage and affix to the inwardly folded first end portion of the first blank of material in accordance with a step-wise assembly of one embodiment of the present invention.

In FIG. 7, the first side panel 16 and the fixation panel 24 of the first blank 12 are inwardly folded or rotated approximately 180 degrees about line 30. In this configuration, the inner surface of the first side panel 16 of the first blank 12 engages and becomes adhesively affixed to the second adhesive area 118 and the fourth adhesive area 121 of the second blank 14. In this configuration, the inner surface of the first side panel 16 of the first blank 16 contacts and is adhesively affixed to the outer surfaces of both fixation panels 66 and 74 of the second blank 14. Furthermore, the third adhesive area 120 engages and becomes adhesively affixed to the outer surface of the rear panel 22 of the first blank 12. That is to say that the inner surface of the fixation panel 24 of the first blank 12 contacts and is adhesively affixed to the outer surface of the rear panel 22 of the first blank 12.

Still referring to FIG. 7, the display 10 is shown in its fully affixed configuration, where the first blank 12 is adhesively affixed to the second blank 14, albeit in a generally flattened configuration. The generally flattened configuration of the display 10 shown in FIG. 7 is well suited for ease of shipping and storage. The display 10 may then be erected into a standing configuration upon demand by folding the display 10 about the generally parallel fold lines 29, 30, 32, and 34 of the first blank 12, and fold lines 76, 78, 80, and 84 of the second blank 14 in combination.

Turning now to FIGS. 8 through 14, the display 10 is shown in an erected configuration and various steps during the process of folding the display 10 into its fully assembled configuration, including folding the series of front shelf portions 38, rear shelf portions 86, first pivotable handling braces 104, and second pivotable handling braces 106 into their final configuration for use as the shelving display 10.

Figure 8:
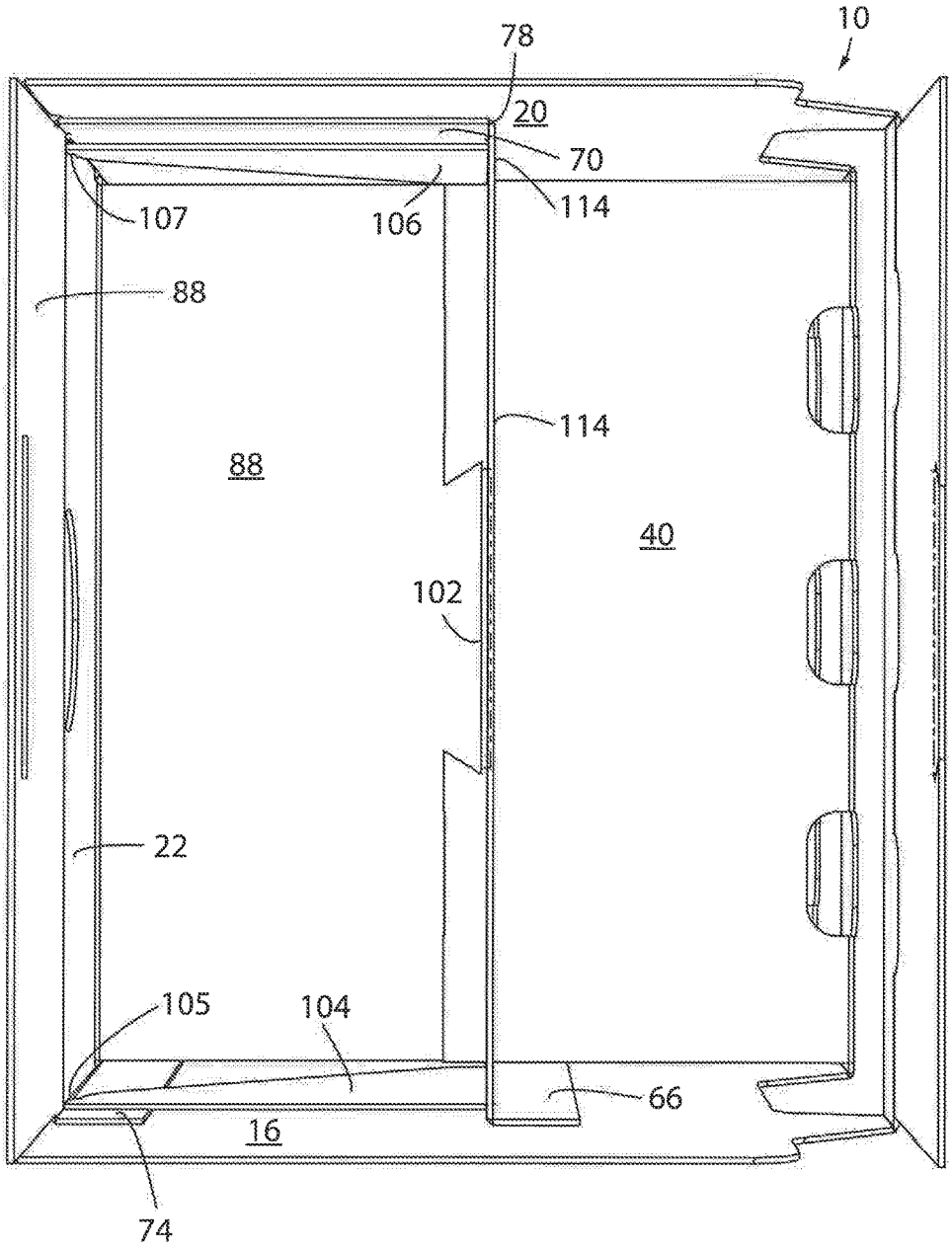
FIG. 8 is a top perspective view of the first blank of material engaging and affixed to the second blank of material in an erected configuration without downwardly folded shelf panels in accordance with a step-wise assembly of one embodiment of the present invention.
Figure 9:
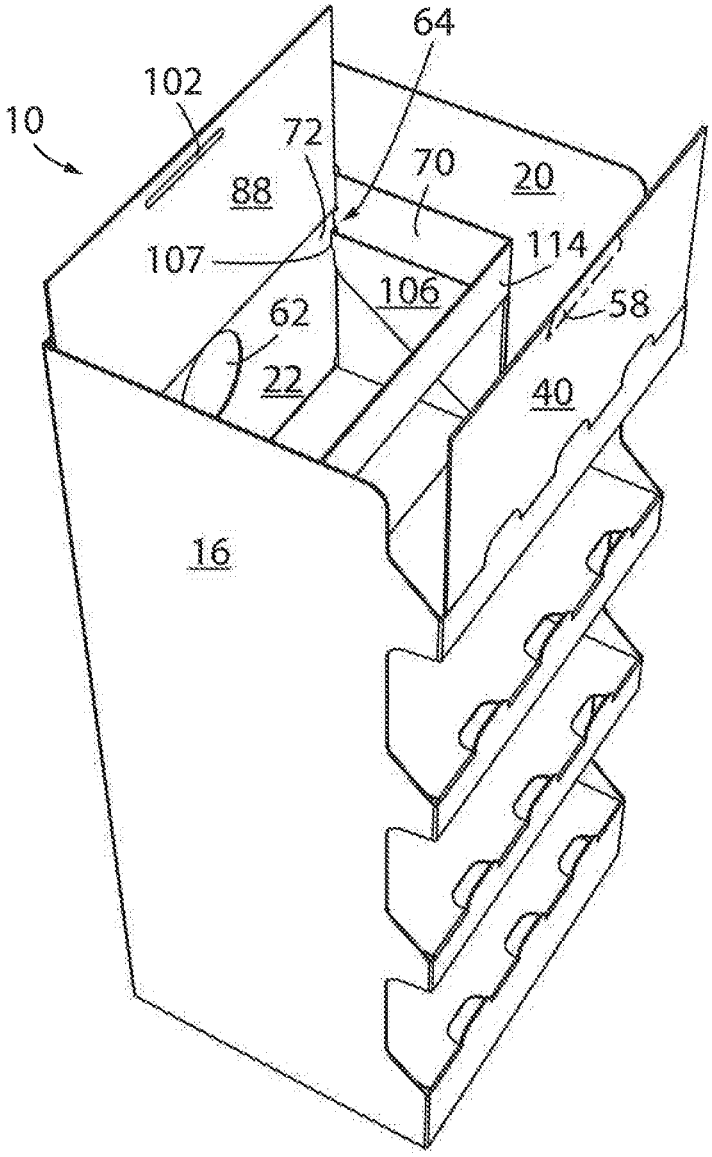
FIG. 9 is a perspective view of the first blank of material engaging and affixed to the second blank of material in an erected configuration with the top most shelf panels in an unfolded configuration and the bottom shelf panels in a downwardly folded shelf configuration in accordance with a step-wise assembly of one embodiment of the present invention.

Referring now to FIGS. 8 and 9, views of the display 10 are shown in which fold lines 29, 30, 32, and 34 of the first blank 12, and fold lines 76, 78, 80, and 84 of the second blank 14 have all substantially been folded approximately 90 degrees such that the first and second blanks 12, 14, in their adhesively affixed configuration form a generally incomplete elongated cuboid display 10. In FIGS. 8 and 9, the uppermost front and rear shelf portions 38, 86 within the series of front and rear shelf portions 38, 86 are each shown in their previously described unfolded configuration, while the remaining lower front and rear shelf portions 38, 86 have been folded downward. The uppermost second pivotable handling brace 106 within the series of second pivotable handling braces 106 has been rotated approximately 90 degrees inwardly about its fold line 78, such that the uppermost second pivotable handling brace 106 lies against and substantially parallel to the inner surface of the second side panel 70 of the second blank 14, which itself lies against and substantially parallel to the inner surface of the second side panel 20 of the first blank 12. The uppermost second pivotable handling brace 106 is retained in this folded position by means of a distal end 107 of the second pivotable handling brace 106 extending through and/or otherwise engaging a corresponding aperture 64 located along the crease line 34 between the rear panel 22 and the second side panel 20.

On the opposing side of the display, the uppermost first pivotable handling brace 104 within the series of first pivotable handling braces 104 has been rotated approximately 90 degrees inwardly about its fold line 76, such that the uppermost first pivotable handling brace 104 lies against and substantially parallel to the inner surface of the fixation panel 74 of the second blank 14, which itself lies against and substantially parallel to the inner surface of the first side panel 16 of the first blank 12. The uppermost first pivotable handling brace 104 is retained in this folded position by means of a distal end 105 of the first pivotable handling brace 104 extending through and/or otherwise engaging a corresponding aperture 65 located along the side edge of the rear panel 22 opposite fold line 34. In this configuration, the inward folding of the first and second pivotable handling braces 104, 106 has exposed the support braces or ribs 114 for receiving the front and rear shelf portions 38, 86, as will be described below.

Figure 10:
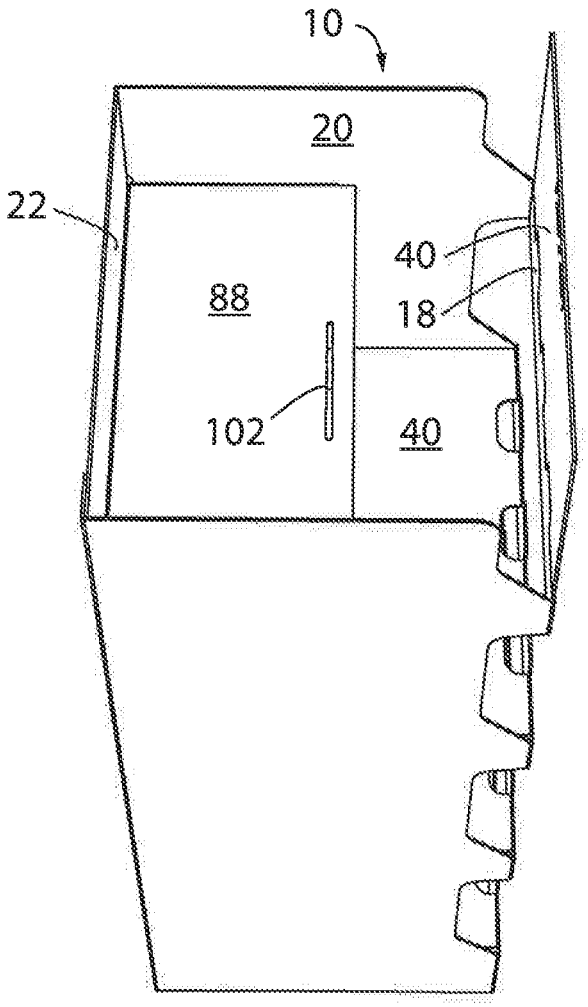
FIG. 10 is a side perspective view of the first blank of material engaging and affixed to the second blank of material in an erected configuration with the rear top most shelf panel in a downwardly folded configuration, the front top most shelf panel in an unfolded configuration, and the bottom shelf panels in a downwardly folded shelf configuration in accordance with a step-wise assembly of one embodiment of the present invention.

Turning now to FIG. 10, the rear shelf panel 88 of the uppermost rear shelf portion 86 has been folded downward approximately 90 degrees about fold line 90. In this folded configuration, the lower or bottom surface of the rear shelf panel 88 engages the upper edge of the corresponding rib 114, to support the rear shelf panel 88. Furthermore, the rib 114 is asymmetrically located along the depth of the display 10, such that the tab receiving slot 102 is located adjacent to and slightly rearwardly of the rib 114 when the bottom surface of the rear shelf panel 88 engages the upper edge of the corresponding rib 114. This location allows the tab 58 to pass through the tab receiving slot 102 and contact the rib 114 from below the bottom surface of the rear shelf panel 88, as to avoid disengagement of the tab 58, as shown in the subsequent figures.

Figure 11:
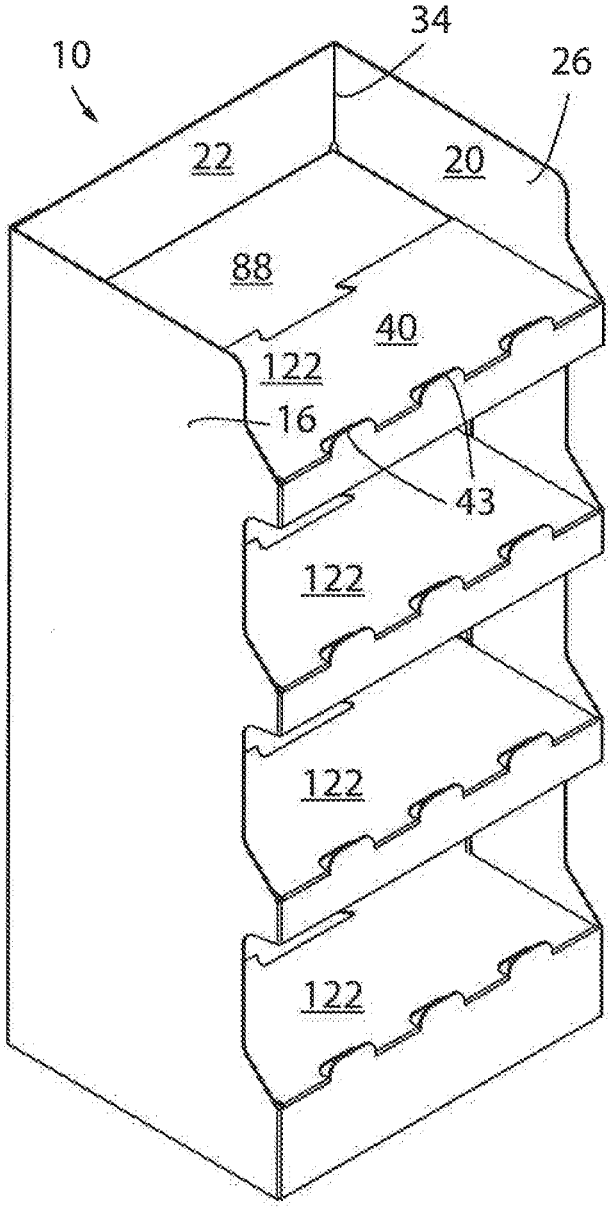
FIG. 11 is a side perspective view of the first blank of material engaging and affixed to the second blank of material in an erected configuration with the shelf panels in a downwardly folded shelf configuration in accordance with a step-wise assembly of one embodiment of the present invention.
Figure 12:
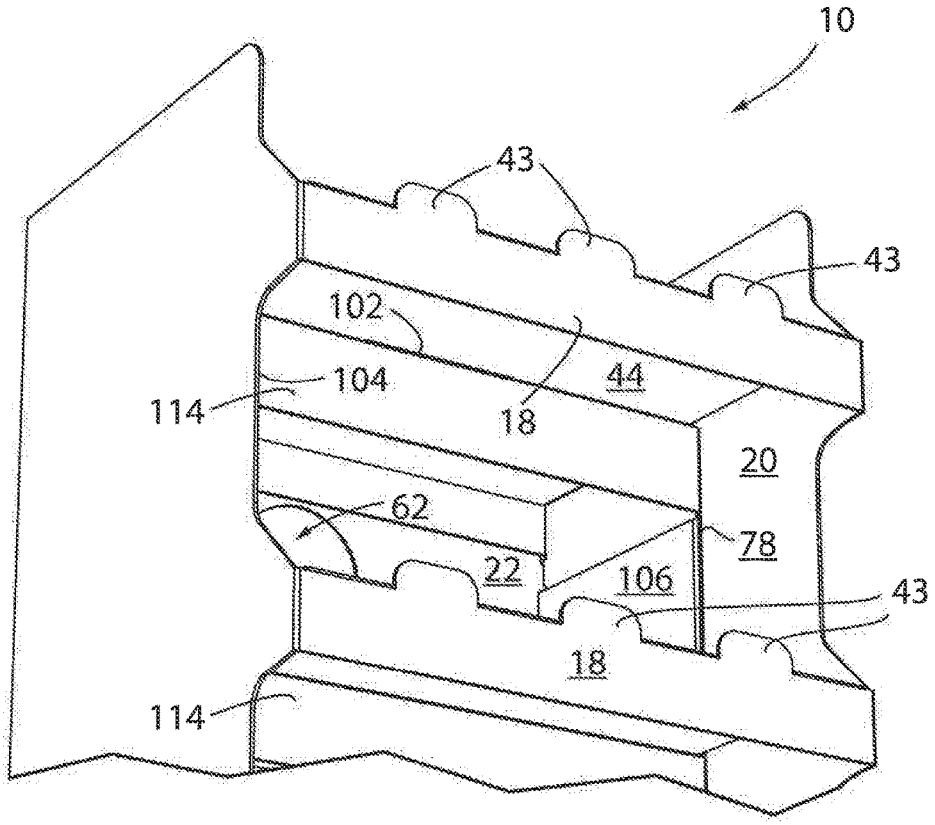
FIG. 12 is a perspective view of a folded and erected display in accordance with one embodiment of the present invention showing a bottom surface of the top shelf in a folded configuration.
Figure 13:
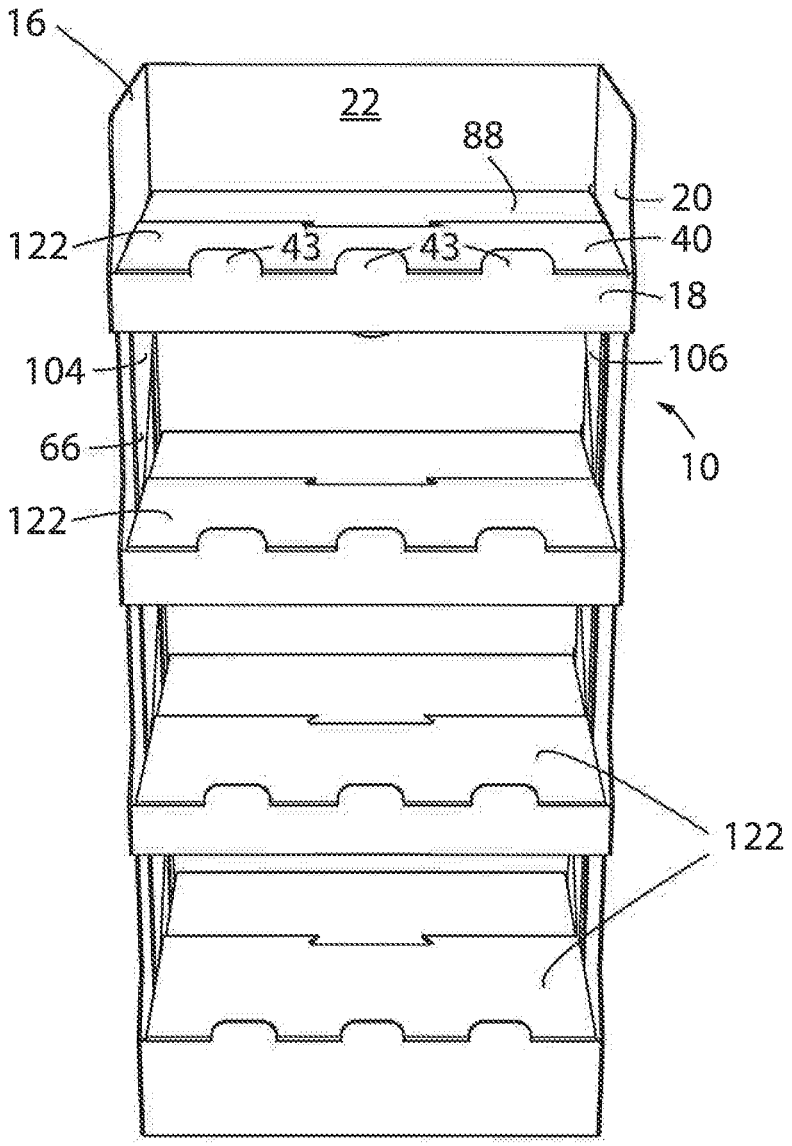
FIG. 13 is a front perspective view of the first blank of material engaging and affixed to the second blank of material in an erected configuration with the shelf panels in a downwardly folded shelf configuration in accordance with a step-wise assembly of one embodiment of the present invention.
Figure 14:
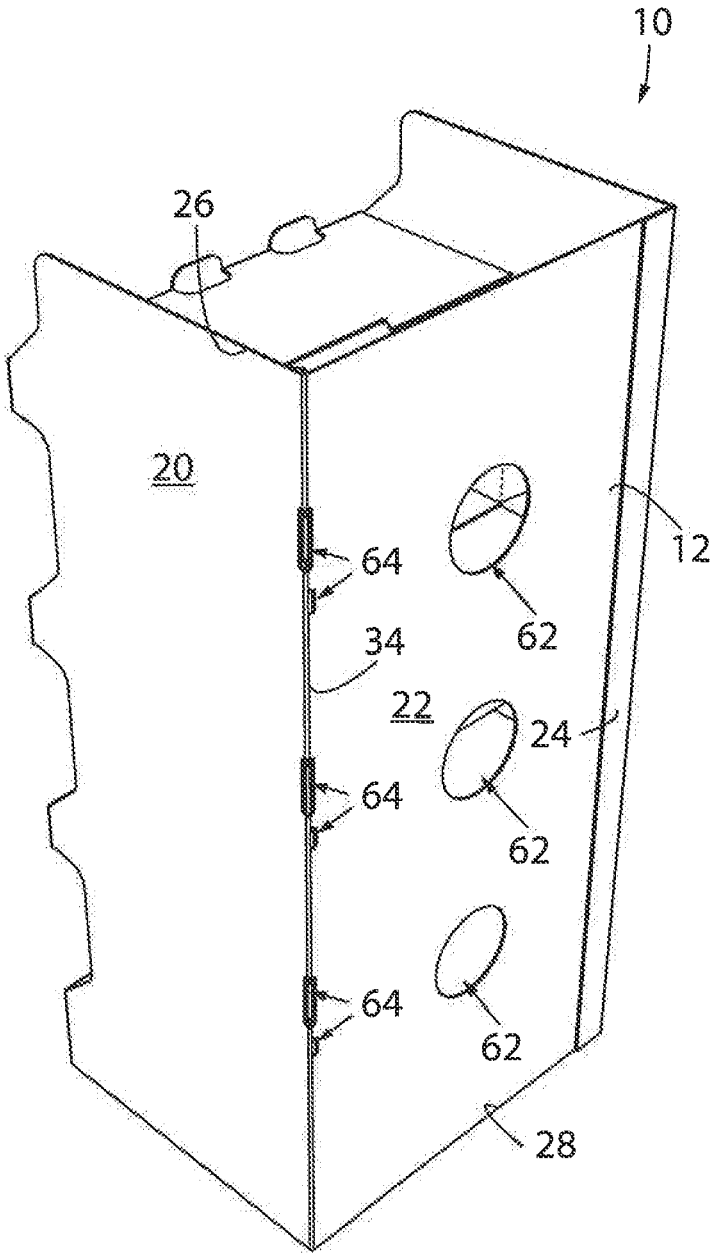
FIG. 14 is a rear perspective view of the first blank of material engaging and affixed to the second blank of material in an erected configuration with the shelf panels in a downwardly folded shelf configuration in accordance with a step-wise assembly of one embodiment of the present invention.

Turning now to FIGS. 11-14, the corresponding front shelf panel 40 of the uppermost front shelf portion 38 has been folded downwardly and rearwardly approximately 90 degrees about fold line 42. In this folded configuration, front shelf panel 40 of the uppermost front shelf portion 38 is approximately substantially coplanar with the rear shelf panel 88 of the uppermost rear shelf portion 86. That is to say that the front shelf panel 40 of the uppermost front shelf portion 38 and the rear shelf panel 88 of the uppermost rear shelf portion 86 cooperate to form a shelf surface 122 which extends across approximately substantially the interior cross-sectional area of the shelf display 10. As was previously described above, when the front shelf panel 40 is folded downward, its tab 58 is directed into the tab receiving slot 102 located within the corresponding rear shelf panel 88, where it is retained by engagement with the corresponding rib 114 that extends along the width of the shelving display 10. Additionally, as shown in FIGS. 11-13, the upwardly extending tabs 43 that extend from fold line 42 are maintained in a generally upwardly extending position where they are well suited to prevent merchandise from inadvertently falling off of the front of respective shelf surface 122.

Although a specific embodiment is illustrated and discussed above, it is understood that the size and shape of the display 10 may vary greatly to accommodate space requirements and the size and shape of products to be displayed on the shelf surfaces 122. While the figures have illustrated display 10 having a height of approximately 51 inches, a width of approximately 21 inches and a depth of approximately 18 inches, larger or smaller displays 10 are considered well within the scope of the present invention. Similarly, any number, location, variation or combination in the multiple styles of shelf panels, braces, ribs, and crease lines described herein is considered within the scope of the present invention. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A collapsible display, having:

a first blank of material defining a plurality of outer panels of the display and a plurality of front shelf portions;

the first blank affixed to a second blank of material, wherein the second blank of material defines a plurality of rear shelf portions, a plurality of ribs and a series of pivotable braces;

the first and second blanks of material configured to be secured to each other and folded into an erected configuration wherein the front shelf portions respectively engage corresponding rear shelf portions to define a plurality of shelf surfaces having a surface area substantially equal to a cross-sectional area of the display in the erected configuration and each of the ribs engages an underside of a shelf surface along a width of the display.

2. The collapsible display of claim 1, wherein each rib engages an underside of the shelf surface at a location that is asymmetrically disposed along a depth of the shelf surface.

3. The collapsible display of claim 2, wherein the plurality of outer panels includes a front panel, and a rear panel, and wherein a first distance extending from the rib to the front panel of the display is greater than a second distance extending from the rib to the rear panel of the display.

4. The collapsible display of claim 1, wherein an underside of the rear shelf portion engages an upper edge of the rib.

5. The collapsible display of claim 1, wherein the series of pivotable braces are disposed between adjacent ribs.

6. The collapsible display of claim 5, wherein the plurality of panels includes one or more side panels, and wherein in the erected configuration each brace in the series of pivotable braces is pivoted into a folded position substantially parallel with one of the side panels of the display in the erected configuration.

7. The collapsible display of claim 6, wherein in the erected configuration the second blank comprises a series of voids between adjacent ribs when the series of pivotable braces are pivoted into the folded position, and wherein the voids are sized to allow a corresponding rear shelf portion to pass therethrough without obstruction.

8. The collapsible display of claim 5, wherein in an unfolded substantially flat configuration the plurality of ribs and series of pivotable braces are approximately coplanar.

9. The collapsible display of claim 8, wherein the second blank comprises a plurality of panels that are foldably connected together, and wherein the plurality of ribs and series of pivotable braces are provided on one of the panels of the second blank.

10. The collapsible display of claim 8, wherein the ribs are alternatingly disposed between the pivotable braces, and wherein the ribs are separated from the pivotable braces by perforation lines that are configured to be ruptured when the first and second blanks of material are folded into an erected configuration.

11. The collapsible display of claim 1, wherein each of the front shelf portions comprises a tab and each of the rear shelf portions comprises a slot configured to receive the tab when the front shelf portions respectively engage corresponding rear shelf portions.

12. The collapsible display of claim 11, wherein when the front shelf portions respectively engage corresponding rear shelf portions the tab extends through the tab receiving slot and engages the corresponding rib in a frictional engagement that inhibits disengagement of the corresponding front shelf portion and rear shelf portion.

13. The collapsible display of claim 1, wherein each of the shelf surfaces comprises a series of upwardly extending tabs disposed along a front edge of the shelf surface.

14. The collapsible display of claim 1, further comprising a series of voids in a rear panel of the first blank disposed adjacent corresponding rear shelf portions of the second blank and configured to allow user engagement with the rear shelf portions through the void.

15. A shelving display, having:

a first blank of material comprising a front panel, a rear panel, a first side panel extending between the front panel and the rear panel, an opposing second side panel extending between the front panel and the rear panel, and a plurality of front shelf portions;

the first blank affixed to a second blank of material, wherein the second blank of material defines a plurality of rear shelf portions, a plurality of pivotable braces, and a plurality of ribs extending generally from the first side panel to the opposing second side panel; and wherein the front shelf portions respectively engage corresponding rear shelf portions to define a plurality of shelf surfaces, the shelf surfaces having a surface area substantially equal to a cross sectional area of the display in the erected configuration.

16. The shelving display of claim 15, wherein an upper edge of each of the ribs engages an underside of a corresponding shelf surface along a width of the display in the erected configuration.

17. The shelving display of claim 15, wherein in the erected configuration each brace in the series of pivotable braces is pivoted into a folded position substantially parallel with the first and second side panels of the display.

18. The collapsible display of claim 17, wherein in the erected configuration the second blank comprises a series of voids between adjacent ribs when the series of pivotable braces are pivoted into the folded position, and wherein the voids are sized to allow a corresponding rear shelf portion to pass therethrough without obstruction.

19. A method of folding a collapsible display, comprising the steps of:

pivoting a first and second blank of material about respective pivot lines, wherein the first blank comprises a plurality of elongated outer panels that are separated by the pivot lines and the second blank comprises a plurality of elongated inner panels that are separated by the pivot lines, and wherein the second blank is affixed to the first blank;

transitioning the first and second blank of material from a generally flat configuration to a generally erected configuration;

folding a plurality of pivotable braces disposed within an elongated panel of the second blank into a folded configuration to reveal a series of voids disposed between adjacent ribs that extend laterally between opposing sides of the display;

folding a series of rear shelf portions that extend from the second blank through the corresponding void to a folded position that engages an upper edge of a corresponding rib with an underside of the rear shelf portion; and folding a corresponding series of front shelf portions that extend from the first blank to form a series of shelf surfaces having a surface area substantially equal to a cross sectional area of the display in the erected configuration.

20. The method of claim 19, wherein forming the series of shelf surfaces further comprises:

folding the rear shelf portions that extend from the second blank from a rear of the collapsible display towards a front of the collapsible display;

folding the front shelf portions that extend from the first blank from the front of the collapsible display towards the rear of the collapsible display;

extending a tab from the front shelf portion through a tab receiving slot in the corresponding rear shelf portion; and forming a frictional engagement between the rib and the tab adjacent the underside of the rear shelf portion.

* * * * *